US008678241B2

(12) United States Patent
Wang

(10) Patent No.: US 8,678,241 B2
(45) Date of Patent: Mar. 25, 2014

(54) FOAM SPRAY HEAD ASSEMBLY

(76) Inventor: Ya-Tsan Wang, HsinChu (TW)

( * ) Notice: Subject to any disclaimer, the term of this patent is extended or adjusted under 35 U.S.C. 154(b) by 0 days.

(21) Appl. No.: 13/594,884

(22) Filed: Aug. 27, 2012

(65) Prior Publication Data

US 2014/0054321 A1 Feb. 27, 2014

(51) Int. Cl.
*B67D 7/76* (2010.01)

(52) U.S. Cl.
USPC ..... 222/190; 222/321.9

(58) Field of Classification Search
USPC ..... 222/135, 137, 145.5, 145.6, 190, 320, 222/321.1, 321.2, 321.7, 321.9, 382, 383.1, 222/385, 464.1; 139/333, 334, 419, 419.5; 239/333, 334, 419, 419.5
See application file for complete search history.

(56) References Cited

U.S. PATENT DOCUMENTS

| | | | | |
|---|---|---|---|---|
| 5,611,490 | A * | 3/1997 | Barriac et al. | 239/333 |
| 5,813,571 | A * | 9/1998 | Gaucher | 222/95 |
| 6,021,924 | A * | 2/2000 | Suck et al. | 222/105 |
| 6,536,629 | B2 * | 3/2003 | van der Heijden | 222/190 |
| 6,612,468 | B2 * | 9/2003 | Pritchett et al. | 222/190 |
| 7,147,133 | B2 * | 12/2006 | Brouwer et al. | 222/145.5 |
| 7,717,301 | B2 * | 5/2010 | Tsai | 222/190 |
| 7,735,692 | B2 * | 6/2010 | Nelson | 222/190 |
| 7,802,701 | B2 * | 9/2010 | Jahan et al. | 222/153.13 |
| 8,028,861 | B2 * | 10/2011 | Brouwer | 222/190 |
| 8,079,497 | B2 * | 12/2011 | Brouwer | 222/153.13 |
| 8,109,415 | B2 * | 2/2012 | Tu | 222/190 |
| 8,430,273 | B2 * | 4/2013 | Brouwer | 222/190 |
| 2002/0056730 | A1 * | 5/2002 | van de Heijden | 222/190 |
| 2002/0070238 | A1 * | 6/2002 | Pritchett et al. | 222/189.11 |
| 2004/0069807 | A1 * | 4/2004 | Brouwer et al. | 222/175 |
| 2007/0045350 | A1 * | 3/2007 | Lin | 222/321.9 |
| 2009/0039110 | A1 * | 2/2009 | Brouwer | 222/190 |
| 2009/0039111 | A1 * | 2/2009 | Tu | 222/190 |
| 2010/0176158 | A1 * | 7/2010 | Carta | 222/321.9 |
| 2010/0320232 | A1 * | 12/2010 | van der Heijden et al. | 222/135 |
| 2011/0168739 | A1 * | 7/2011 | Brouwer | 222/190 |
| 2011/0272432 | A1 * | 11/2011 | Baughman | 222/136 |
| 2011/0297700 | A1 * | 12/2011 | Santagiuliana | 222/153.13 |
| 2012/0080454 | A1 * | 4/2012 | Wang | 222/321.2 |
| 2012/0080539 | A1 * | 4/2012 | Wang | 239/289 |
| 2012/0228335 | A1 * | 9/2012 | Santoni | 222/321.9 |
| 2012/0267399 | A1 * | 10/2012 | Moretti | 222/321.2 |
| 2012/0292347 | A1 * | 11/2012 | Wang | 222/321.2 |
| 2012/0305604 | A1 * | 12/2012 | Wang | 222/321.9 |

* cited by examiner

*Primary Examiner* — Kevin P Shaver
*Assistant Examiner* — Patrick M Buechner

(57) ABSTRACT

A foam spray head assembly includes a press head connected to a cap, a netted tube, a valve member, a main tube, a piston unit, a link unit, a resilient member, a cylinder unit and a valve. The netted tube is connected to the valve member. An outlet is defined between the first link of the link unit and the first tube. An inlet is defined between the second link of the link unit and the protrusion of the piston unit. The resilient member is mounted to the second tube and contacts the flange of the second tube. The first piston of the cylinder unit is movable in the first cylinder to form a sealed second chamber. The second piston of the cylinder unit is movable in the second cylinder to form a sealed third chamber. The valve is located in the passage of the second cylinder.

9 Claims, 8 Drawing Sheets

31、32

FOAM SPRAY HEAD ASSEMBLY

BACKGROUND OF THE INVENTION (1) Field of the Invention

The present invention relates to a spray head assembly, and more particularly, to a foam spray head assembly with sealing feature.

(2) Description of the Prior Art

The conventional liquid detergent is received in a container and a pump head is connected to the top of the container so as to suck the liquid from the container. When foam-type detergent is needed, the users generally get the liquid from the container by operating the pump head and then scrub the liquid to generate bubbles. However, the amount of the liquid is difficult to control and the excess detergent may be harmful to the users when attached on the plates. The same concern is also found when using shampoo or body gel.

The present invention intends to provide an improved foam spray head assembly which can generate foam-type detergent for convenience of use.

SUMMARY OF THE INVENTION

The present invention relates to a foam spray head assembly and comprises a press head connected with a cap. A netted tube has a first net, a second net and a hollow tube. A valve member has a first end and a second end, the first end of the valve member had a first recess, a second recess, an inlet valve and a release path. The second end of the valve member is connected with the netted tube. A main tube is a hollow tube and has a first tube, a second tube, a flange, a stop and a guide slot. The first tube is located in the second recess and defines a first chamber. A first gap is defined between the outer periphery of the first tube and the inner periphery of the second recess.

A piston unit has a first piston and a second piston. The first piston has a third recess, a fourth recess, an air hole, an air slot and a seal ring. The wall defining the fourth recess is movably in contact with the inner periphery of the first recess and movably seals the inlet valve. The guide slot is located between the stop and the seal ring which movably seals and opening the guide slot. The guide slot communicates with the air hole and the air slot. The second piston has a fifth recess, a sixth recess and a protrusion. The second piston is connected to the second tube.

A link unit extends through the main tube and has a first link, a second link and an engaging portion, wherein the first link is connected to the second link by the engaging portion. The first link has a contact neck which is movably in contact with the inner periphery of the first tube. An outlet is defined between the first tube and the contact neck. The second link has a contact portion which is movably in contact with the protrusion. An inlet is defined between the protrusion and the contact portion. The link unit is located in the second tube. A second gap is defined between the second tube and the link unit. A resilient member is mounted to the second tube and has one end contacting the flange.

A cylinder unit is connected to the cap and has a first cylinder and a second cylinder. A ring is located between the first and second cylinders. The first piston is repeatedly movable in the first cylinder and forms a sealed second chamber. The wall defining the third recess is movably in contact with the inner periphery of the first cylinder. A fourth chamber is defined between the third recess, the first recess and the cap. The second piston is repeatedly movable in the second cylinder and forms a sealed third chamber. A valve is in contact with a passage in the second cylinder.

The resilient member is mounted to the second tube and the liquid passes through the second tube so that the liquid is not in contact with the resilient member.

The apertures of the first and second nets are hexagonal apertures so as to generate fine foam.

The wall defining the fourth recess is movable in the first recess and seals the inlet valve. The guide slot is located between the seal ring and the stop. The seal ring movably seals the guide slot and the guide slot communicates with the air hole and the air slot so that the air passes through the second and fourth chambers. The sealing feature of the present invention is improved.

The contact neck of the first link is movably in contact with the inner periphery of the first tube, and the outlet is defined between the first tube and the first link. The contact portion of the second link is movably in contact with the protrusion of the second piston, and the inlet is defined between the protrusion and the second link so as to control the movement of the liquid. The present invention is more reliable and sensitive.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
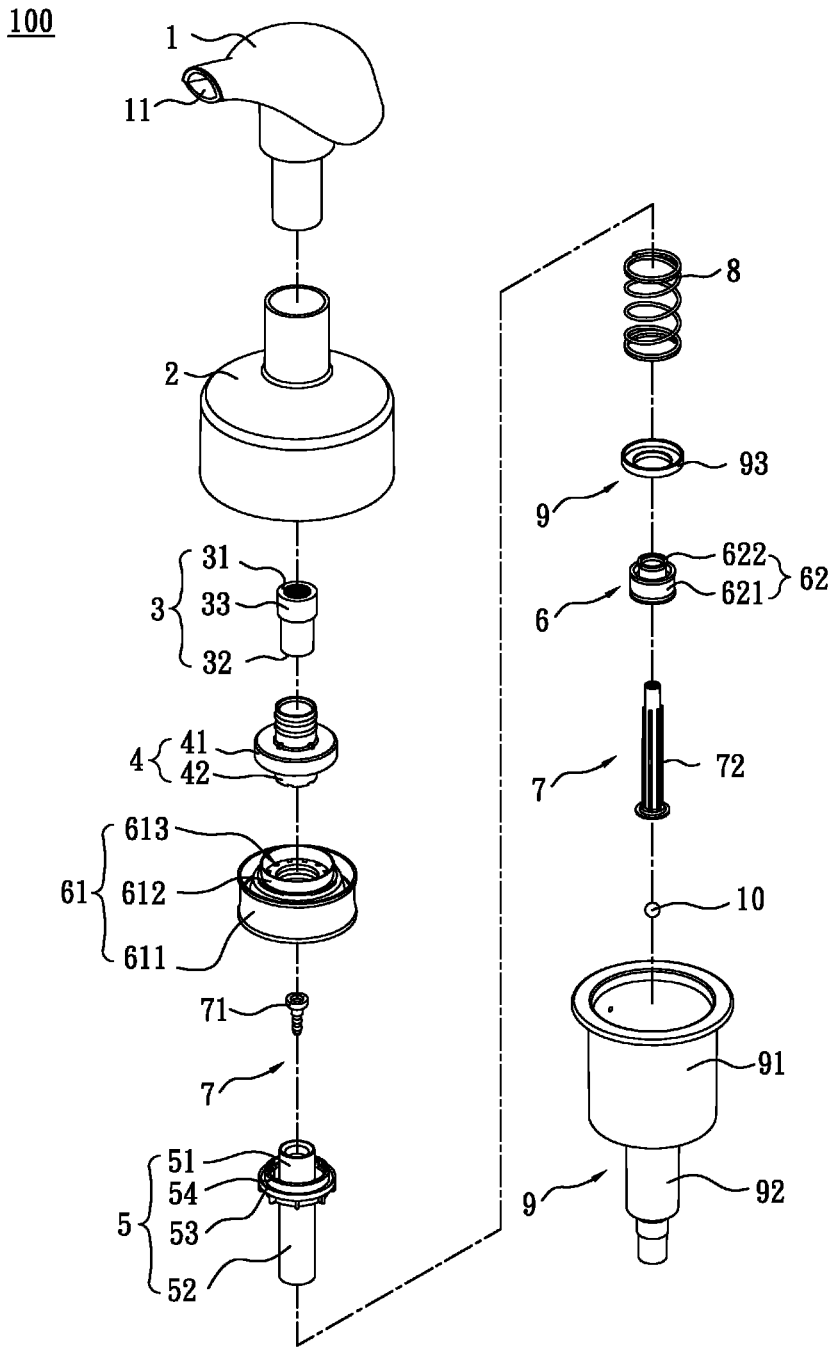
FIG. 1 is an exploded view to show the spray head assembly of the present invention.

Referring to FIG. 1, the foam spray head assembly 100 of the present invention comprises a press head 1, a cap 2, a netted tube 3, a valve member 4, a main tube 5, a piston unit 6, a link unit 7, a resilient member 8, a cylinder unit 9 and a valve 10.

The press head 1 has a nozzle 11 for spraying the foam and the press head 1 is connected with the cap 2. The cap 2 has threads defined in the inner periphery thereof and the cap 2 is threadedly connected to a container. The netted tube 3 has a first net 31, a second net 32 and a hollow tube 33.

Figure 1A:
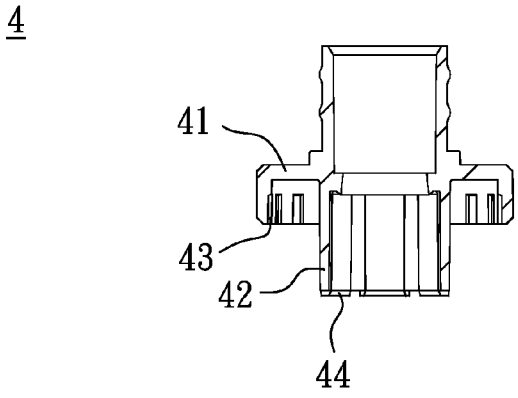
FIG. 1A is a cross sectional view to show the valve member of the spray head assembly of the present invention.

Referring to FIG. 1A, the valve member 4 has a first end and a second end, wherein the first end of the valve member 4 has a first recess 41, a second recess 42, an inlet valve 43 and a release path 44. The second end of the valve member 4 is connected with the netted tube 3. The inlet valve 43 is located in the first recess 41 and the release path 44 is located in the second recess 42.

Figure 1B:
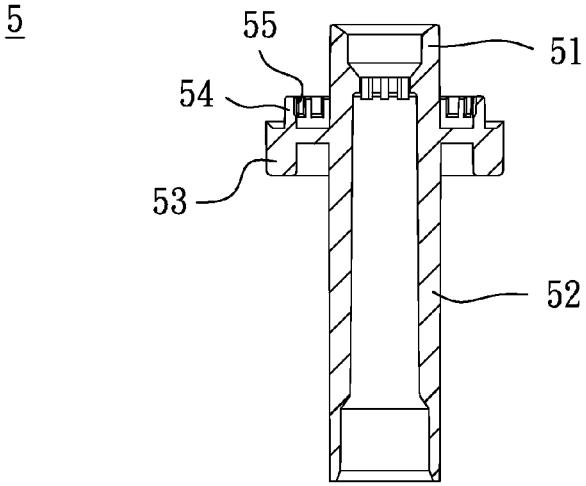
FIG. 1B is a cross sectional view to show the main tube of the spray head assembly of the present invention.

As shown in FIG. 1B, the main tube 5 is a hollow tube and has a first tube 51, a second tube 52, a flange 53, a stop 54 and a guide slot 55. The first tube 51 is located in the second recess 42 and defines a first chamber 40 in the second recess 42. A first gap 50 is defied between the outer periphery of the first tube 51 and the inner periphery of the second recess 42. Air passes through the gap 50.

Figure 1C:
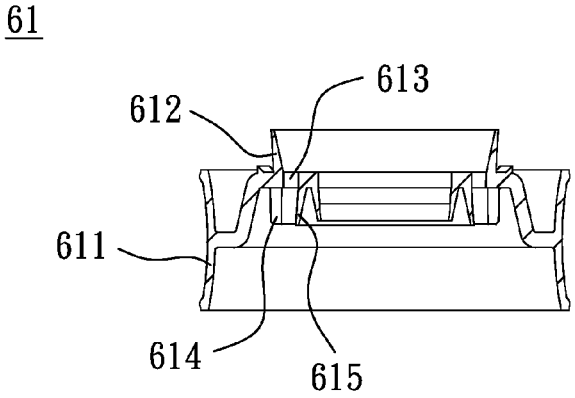
FIG. 1C is a cross sectional view to show the first piston of the spray head assembly of the present invention.

The piston unit 6 has ring-shaped a first piston 61 and a second piston 62. As shown In FIG. 1C, the first piston 61 has a third recess 611, a fourth recess 612, an air hole 613, an air slot 614 and a seal ring 615. The wall defining the fourth recess 612 is movably in contact with the inner periphery of the first recess 41 and movably seals the inlet valve 43. The guide slot 55 is located between the stop 54 and the seal ring 615 which movably seals and opening the guide slot 55. The guide slot 55 communicates with the air hole 613 and the air slot 614. The first piston 61 is used to control the movement of the air.

The second piston 62 has a fifth recess 621, a sixth recess 622 and a protrusion 623. The second piston 62 is connected to the second tube 52.

The link unit 7 extends through the main tube 5 and comprises a first link 71, a second link 72 and an engaging portion 73. The first link 71 is connected to the second link 72 by the engaging portion 73. The first link 71 has a contact neck 711 which is movably in contact with the inner periphery of the first tube 51. An outlet 712 is defined between the first tube 51 and the contact neck 711. The second link 72 extends through the second piston 62 and both of the second link 72 and the sixth recess 622 are located in the second tube 52 of the main tube 5. The outer diameter of the link unit 7 is smaller than the inner diameter of the second tube 52. A second gap 70 is defined between the link unit 7 and the inner periphery of the second tube 52. Liquid passes through the second gap 70.

The resilient member 8 is mounted to the second tube 52 and has one end contacting the flange 53. The cylinder unit 9 is connected to the cap 2 and has a first cylinder 91 and a second cylinder 92, wherein a ring 93 is located between the first and second cylinders 91, 92. The other end of the resilient member 8 contacts the ring 93. In this embodiment, the first cylinder 91 is larger than the second cylinder 92, and the first piston 61 is larger than the second piston 62. The wall defining the third recess 611 of first piston 61 is repeatedly movable in the first cylinder 91 and forms a sealed second chamber 80. In this embodiment, the wall defining the third recess 611 is movably in contact with an inner periphery of the first cylinder 91 so as to form a fourth chamber 21 defined between the third recess 611, the first recess 41 and the cap 2. When the press head 1 is pushed downward, the inlet valve 43 seals the fourth chamber 21 and air cannot pass through the inlet valve 43. When the press head 1 moves upward, the inlet valve 43 opens so that the air in the fourth chamber 21 enters into the second chamber 80 via the air hole 613 and the air slot 614. The wall defining the fifth recess 621 of the second piston 62 is repeatedly movable in the second cylinder 92 so as to form a sealed third chamber 90.

The valve 10 is in contact with a passage 921 in the second cylinder 92. The passage 921 of the cylinder unit 9 is connected with a suction hose 923 so as to suck the liquid in the container. In this embodiment, the valve 10 is a bead which moves up and down to open and close the passage 921.

Figure 2:
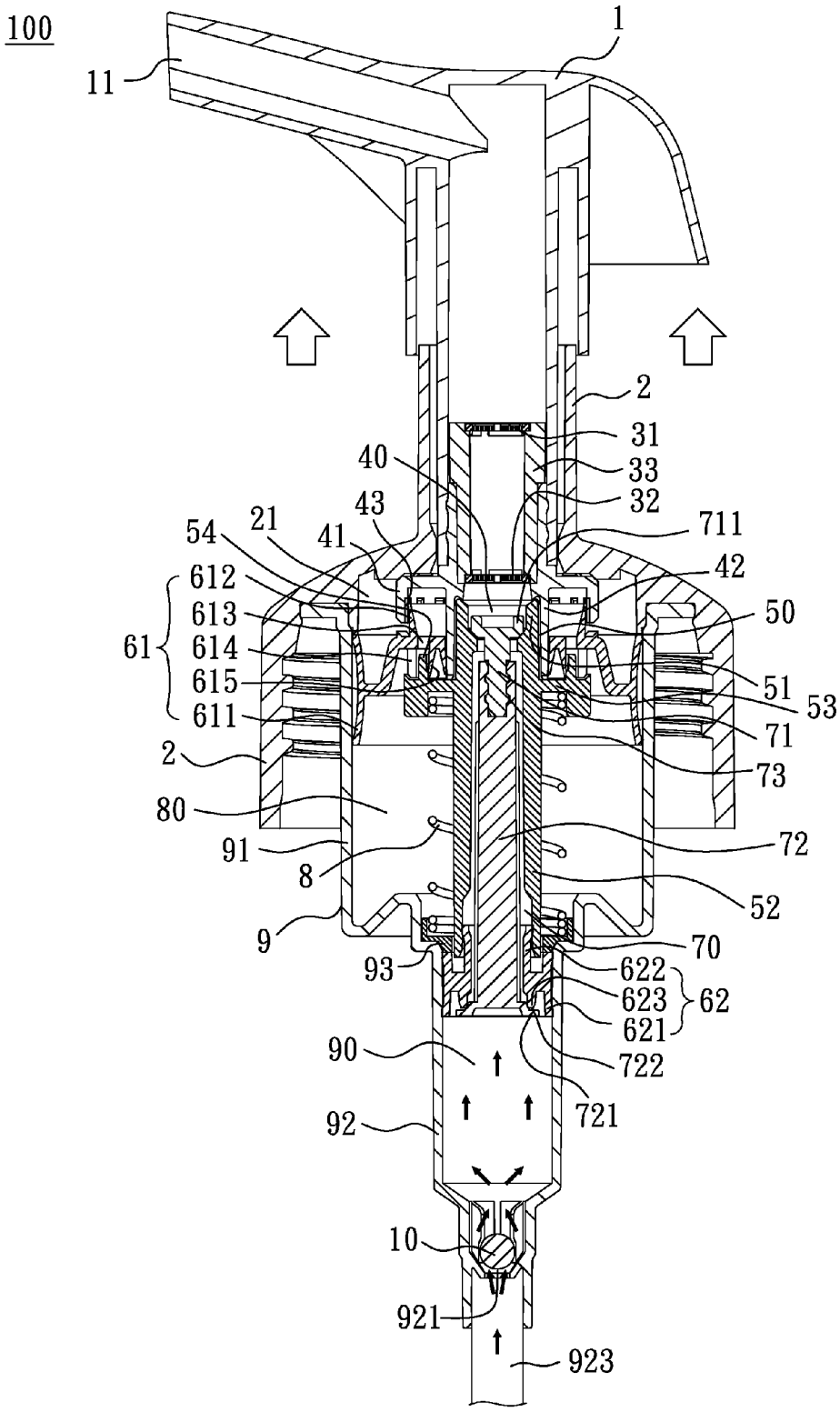
FIG. 2 is a cross sectional view to show the spray head assembly of the present invention.
Figure 2A:
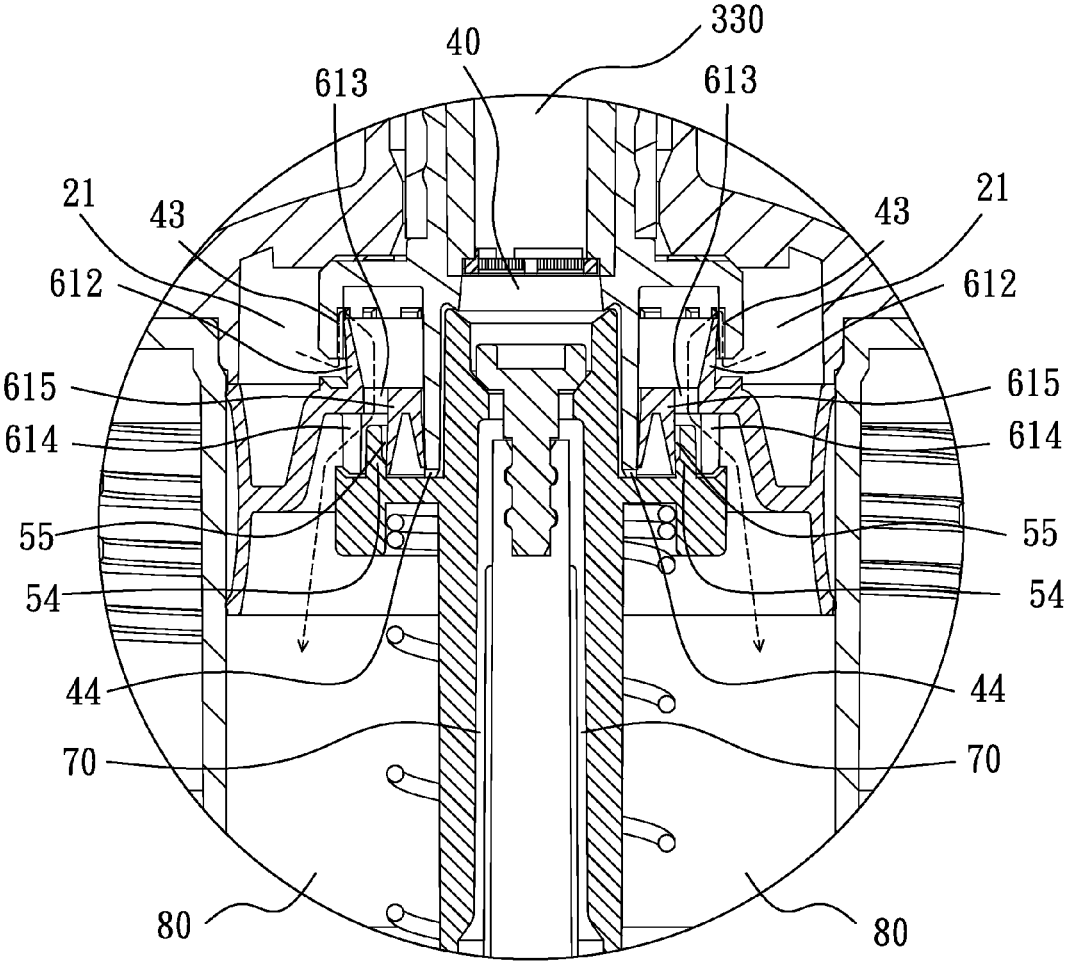
FIG. 2A is a cross sectional view to show that the press head of the spray head assembly of the present invention moves upward.

As shown in FIG. 2A, when the press head 1 moves upward, the inlet valve 43 opens and the air in the fourth chamber 21 enters into the second chamber 80 via the air hole 613 and the air slot 614. The guide slot 55 located between the seal ring 615 and the stop 54 is sealed.

Figure 3:
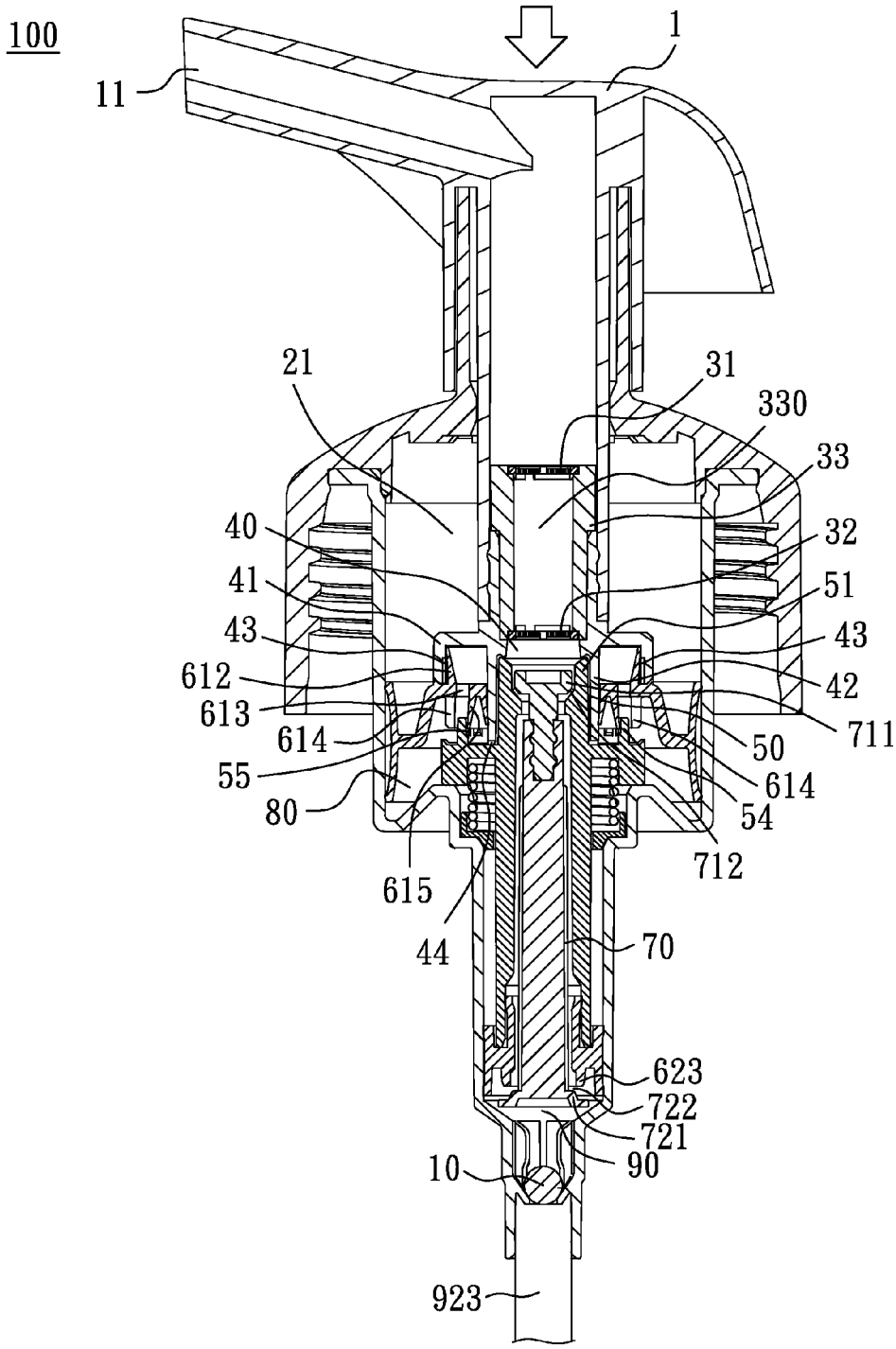
FIG. 3 is a cross sectional view to show another embodiment of the spray head assembly of the present invention.
Figure 3A:
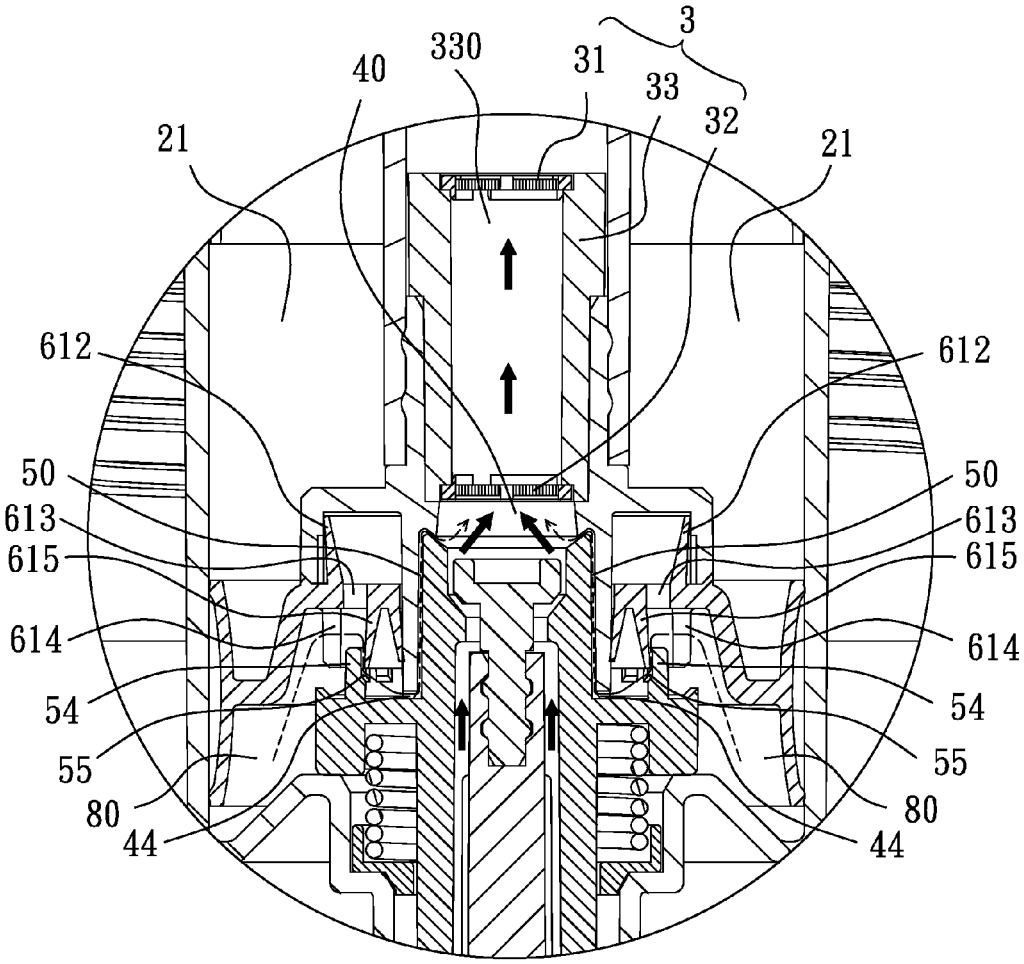
FIG. 3A is a cross sectional view to show that the press head of the spray head assembly of the present invention moves downward.

As shown in FIGS. 1, 3 and 3A, when the press head 1 is pushed downward, the valve member 4 and the main tube 5 are both lowered, and the inlet 722 between the contact portion 721 of the second link 72 and the protrusion 623 of the second piston 62 is opened, the liquid in the third chamber 90 enters the second gap 70 via the inlet 722. When the press head 1 continuously pushed downward, the wall defining the third recess 611 and the wall defining the fifth recess 621 are stopped respectively due to the friction with the first cylinder 91 and the second cylinder 92. The second link 72 of the link unit 7 stops the first link 71 to move downward, so that the contact neck 711 removes from the inside of the first tube 51 and the outlet 712 is opened, the liquid then flows in the first chamber 40 via the second gap 70.

During the downward movement of the press head 1, the inlet valve 43 gradually closed by the fourth recess 612, and the stop 54 of the main tube 5 and the seal ring 615 of the first piston 61 gradually open the guide slot 55, so that the guide slot 55 communicates with the air hole 613 and the air slot 614, and the air in the second chamber 80 flows into the guide slot 55 via the air hole 613 and the air slot 614, and then enters into the first chamber 40 via the release path 44 and the first gap 50. The air mixes with the liquid in the first chamber 40, and generates foams when passing through the first and second nets 31, 32, and the foams is ejected from the nozzle 11 of the press head 1.

Figure 4:
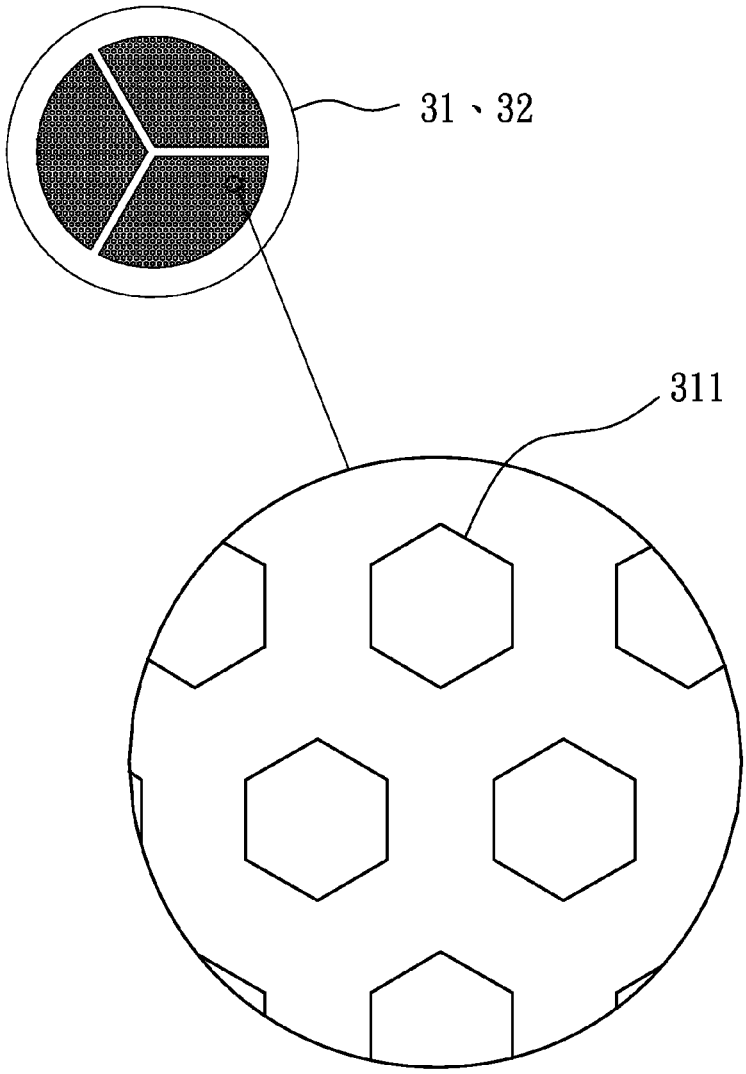
FIG. 4 shows the first and second nets of the spray head assembly of the present invention.

As shown in FIG. 4, the first and second nets 31, 32 are made by way of injection molding, and the first and second nets 31, 32 are secured to two ends of the hollow tube 33. In order to generate fine foams, the apertures of the first and/or second nets 31, 32 are hexagonal apertures, and the apertures in the first net 31 are smaller or equal to the apertures 311 in the second net 32. The hollow tube 33 of the netted tube 3 has a liquid-air mixing area 330. When the liquid and air pass through the larger apertures of the second net 32 and generate larger foams which are located in the liquid-air mixing area 330, and then pass through the first net 31 with smaller apertures to generate fine foams.

As shown in FIGS. 2, 2A and 1, when releasing the press head 1, the resilient member 8 brings the main tube 5 and the valve member 4 upward, the wall defining the third recess 611 and the wall defining the fifth recess 621 are stopped respectively due to the friction with the first cylinder 91 and the second cylinder 92. The second link 72 of the link unit 7 stops the first link 71 to move upward, so that the contact neck 711 is in contact with the inside of the first tube 51 and the outlet 712 is closed. The inlet valve 43 is gradually opened and the guide slot 55 is gradually closed by the stop 54 and the seal ring 615. Along with the upward movement of the main tube 5, the first piston 61, the link unit 7 and the second piston 62 move upward, and the volumes of the second and third chambers 80, 90 increase so as to such outside air into the second chamber 80 via the inlet valve 43, and suck the liquid into the third chamber 90 via the valve 10 and ready for the next pump.

It is noted that the resilient member 8 is mounted to the second tube 52 and the liquid passes through the inside of the second tube 52 so that the liquid is not in contact with the resilient member 8. The liquid is not contaminated and the resilient member 8 does not get rust.

The wall defining the fourth recess 612 is movable in the first recess 41 and seals the inlet valve 43. The guide slot 55 is gradually sealed by the seal ring 615 and the stop 54. The guide slot 55 communicates with the air hole 613 and the air slot 614 so that the air passes through the second and fourth chambers 21, 80. The sealing feature of the present invention is improved.

The outlet 712 is defined between the first tube 51 and the contact neck 711. The inlet 722 is defined between the contact portion 721 of the second link 72 and the protrusion 623 of the second piston 62. The movement of the liquid is then controlled and the suction feature is more sensitive when compared with the conventional suction assemblies.

Figure 5:
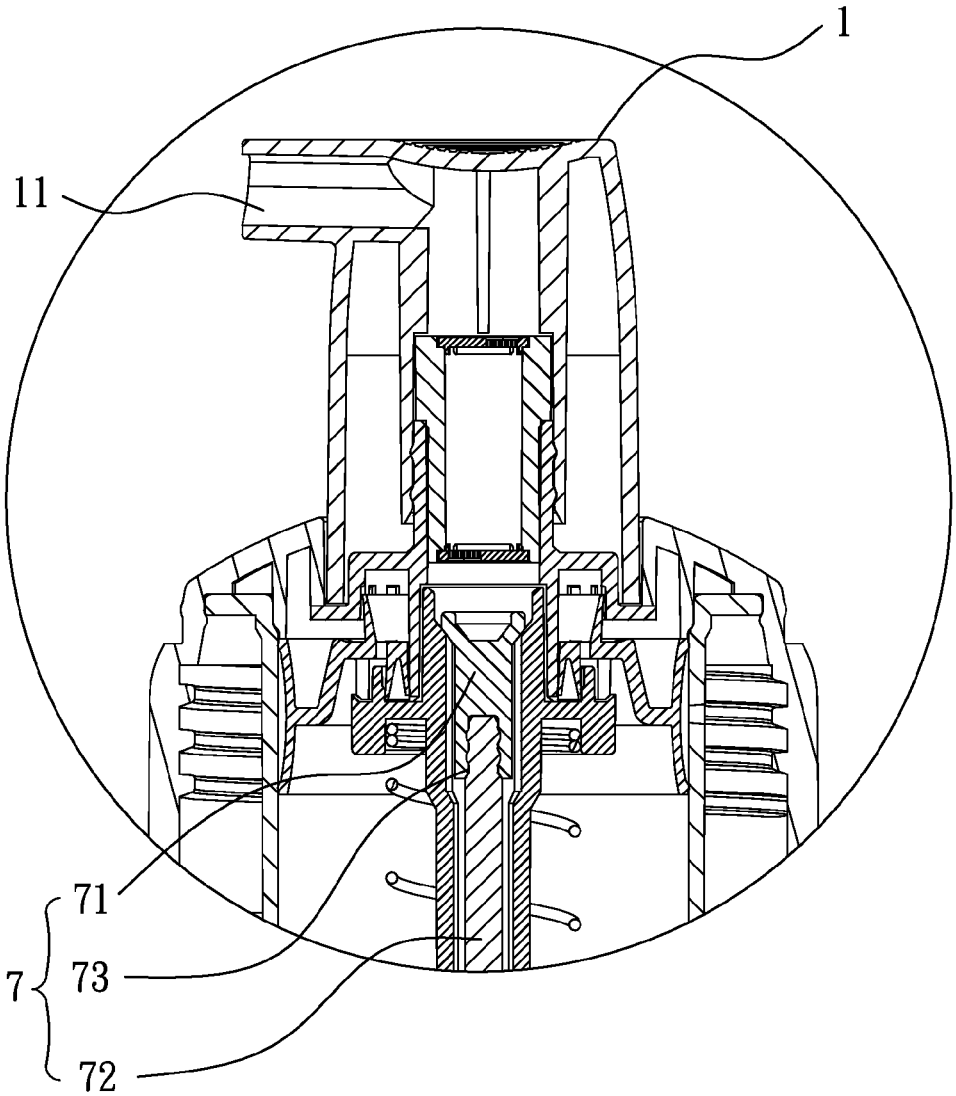
FIG. 5 shows a cross sectional view of the spray head assembly of the present invention.

The nozzle 11 is formed with an upward angle to prevent the foam from dropping at the edge of the nozzle 11. The nozzle 11 can be horizontally formed as shown in FIG. 5. The way of connection between the first and second links 71, 72 are is restricted, they can be connected with each other by the use of the engaging portion 73. In this embodiment, the first link 71 extends through one end of the second link 72 and is connected with the engaging portion 73. Alternatively, as shown in FIG. 5, the second link 72 may extend through the first link 71 and be engaged with the engaging portion 73.

While we have shown and described the embodiment in accordance with the present invention, it should be clear to those skilled in the art that further embodiments may be made without departing from the scope of the present invention.

What is claimed is:

1. A foam spray head assembly comprising:

a press head connected with a cap;

a netted tube having a first net, a second net and a hollow tube;

a valve member having a first end and a second end, the first end of the valve member having a first recess, a second recess, an inlet valve and a release path, the second end of the valve member connected with the netted tube;

a main tube being a hollow tube and having a first tube, a second tube, a flange, a stop and a guide slot, the first tube located in the second recess and defining a first chamber, a first gap defined between an outer periphery of the first tube and an inner periphery of the second recess;

a piston unit having a first piston and a second piston;

the first piston having a third recess, a fourth recess, an air hole, an air slot and a seal ring, a wall defining the fourth recess movably in contact with an inner periphery of the first recess and movably sealing the inlet valve, the guide slot located between the stop and the seal ring which movably seals and opening the guide slot, the guide slot communicating with the air hole and the air slot;

the second piston having a fifth recess, a sixth recess and a protrusion, the second piston connected to the second tube;

a link unit extending through the main tube and having a first link, a second link and an engaging portion;

the first link connected to the second link by the engaging portion;

the first link having a contact neck which is movably in contact with the inner periphery of the first tube, an outlet defined between the first tube and the contact neck;

the second link having a contact portion which is movably in contact with the protrusion, an inlet defined between the protrusion and the contact portion;

the link unit located in the second tube, a second gap defined between the second tube and the link unit;

a resilient member mounted to the second tube and having one end contacting the flange;

a cylinder unit connected to the cap and having a first cylinder and a second cylinder, a ring located between the first and second cylinders;

the first piston repeatedly movable in the first cylinder and forming a sealed second chamber;

a wall defining the third recess movably in contact with an inner periphery of the first cylinder, a fourth chamber defined between the third recess, the first recess and the cap;

the second piston repeatedly movable in the second cylinder and forming a sealed third chamber, and a valve being in contact with a passage in the second cylinder.

2. The assembly as claimed in claim 1, wherein the valve is a bead which moves upward to open the passage and downward to close the passage.

3. The assembly as claimed in claim 1, wherein the first link extends through the second link and is engaged with the engaging portion.

4. The assembly as claimed in claim 1, wherein the second link extends through the first link and is engaged with the engaging portion.

5. The assembly as claimed in claim 1, wherein the hollow tube of the netted tube has a liquid-air mixing area.

6. The assembly as claimed in claim 1, wherein the first and second nets, are made by way of injection molding.

7. The assembly as claimed in claim 1, wherein the apertures of the first and/or second nets are hexagonal apertures.

8. The assembly as claimed in claim 1, wherein the cap has threads defined in an inner periphery thereof and the cap is adapted to be threadedly connected to a container.

9. The assembly as claimed in claim 1, wherein the passage of the cylinder unit is connected with a suction hose.

* * * * *